US005211219A

United States Patent [19]

Kawabata et al.

[11] Patent Number: 5,211,219

[45] Date of Patent: May 18, 1993

[54] AIR CONDITIONER

[75] Inventors: Katsuhiro Kawabata; Hiroyuki Yamashita; Isao Hasegawa; Junichiro Tanaka; Junji Matsushima, all of Osaka, Japan

[73] Assignee: Daikin Industries, Ltd., Osaka, Japan

[21] Appl. No.: 736,443

[22] Filed: Jul. 29, 1991

[30] Foreign Application Priority Data

Jul. 31, 1990 [JP] Japan ..... 2-204450

[51] Int. Cl.[5] ..... F24F 1/00

[52] U.S. Cl. ..... 165/122; 165/124; 165/183

[58] Field of Search ..... 165/122, 124, 907, 183

[56] References Cited

U.S. PATENT DOCUMENTS

| | | | |
|---|---|---|---|
| 2,740,268 | 4/1956 | Jones | 165/124 X |
| 3,540,530 | 11/1970 | Kritzer | 165/146 |
| 3,804,159 | 4/1974 | Searight et al. | 165/109.1 |
| 4,266,602 | 5/1981 | White et al. | 165/124 |

FOREIGN PATENT DOCUMENTS

| | | | |
|---|---|---|---|
| 928417 | 11/1947 | France | 165/124 |
| 54-136740 | 10/1979 | Japan | 165/122 |
| 58-49503 | 11/1983 | Japan . | |
| 59-161622 | 9/1984 | Japan | 165/122 |
| 61-128038 | 6/1986 | Japan | 165/122 |
| 61-192185 | 11/1986 | Japan . | |

*Primary Examiner*—Allen J. Flanigan

*Attorney, Agent, or Firm*—Sixbey, Friedman, Leedom & Ferguson

[57] ABSTRACT

An air conditioner comprising a casing, an air flow passage extending from an air inlet at the upper side of the casing to an air outlet at the lower side of the casing. A cross flow fan is provided within the casing along with a heat exchanger composed by connecting fins through which air is allowed to pass to the outer surface of the heat transfer tube along the lengthwise direction thereof. The heat transfer tube is branched into a plurality of passes in the heat exchanger. The present invention is characterized in that the heat transfer tube is disposed in a direction crossing the axial direction of the cross flow fan. Even if drift of flowing air is caused by the cross flow fan, distribution in the air flow speed and distribution of heat exchanger can be made equal and heat exchanging capacity of high level can be obtained, without causing the trouble of condensed water from the heat exchanger falling into the air flow passage.

12 Claims, 9 Drawing Sheets

AIR CONDITIONER

BACKGROUND OF THE INVENTION

1. Field of the Invention

This invention relates to the construction of an air conditioner, especially an air conditioner provided with a cross flow fan as a blower.

2. Description of the Prior Art

Conventionally, an air conditioner provided with a casing having an air inlet at its upper side, an air outlet at its lower side and an air flow passage from the air inlet to the air outlet, a cross flow fan also known as "tangential fan" or "transverse fan" and a heat exchanger has been known.

As a heat exchanger for the above air conditioner, a cross fin coil comprising many heat transfer tubes fitted with many panel-shaped fins or cross fins is known for example, in Japanese Utility Model Registration Publication No. 58-49503.

However, the speed of flowing air produced by the above cross flow fan has such characteristic that it is faster at one side of the air flow passage and slower at the other side. Due to this drift of air flow, distribution of the air flow speed to the heat exchanger varies. Therefore, in the cross fin coil with the above heat transfer tube branched into plural passes which are disposed in parallel with the axial direction of the cross flow fan, distribution of air flowing speed and distribution of heat load in the air flowing direction (change of temperature) vary with each other and it is difficult to obtain a heat exchanging capacity of high level.

It is true that by disposing each pass of the heat transfer tube in a direction crossing substantially at a right angle to the axial direction of the cross flow fan, unbalance of heat exchanging capacity caused by the drift of air flow can be avoided.

However, in the above case the fin which crosses at a right angle to the heat transfer tube is arranged in a direction which is parallel to the axis of the cross flow fan. Therefore, in the case where a heat exchanger is used as an evaporator, for example, a drain receiver which receives water condensed at the cross fin coil is arranged at a position of each fin in parallel with the axis of the cross flow fan. This arrangement of the drain receiver results in a narrowing of the air flow passage and a reduction in the area of the passage. However, if this drain receiver is omitted, drain water falls into the air flow passage directly from the fin which raises a problem in practical use.

An object of the present invention is to improve the construction of the above heat exchanger, more particularly, to prevent reduction of heat exchanging capacity due to a drift of air flow by using a heat exchanger of mesh-shaped fin type, without raising the positioning problem associated with the use of a drain receiver.

SUMMARY OF THE INVENTION

In order to attain the above object, the air conditioner according to the present invention is provided with a casing having an air inlet at its upper side, an air outlet at its lower side and an air flow passage extending from the air inlet to the air outlet, a cross flow fan and a heat exchanger arranged in series in the air flow passage in the casing.

The heat exchanger mentioned above comprises fins and heat transfer tubes. The heat transfer tube is branched into plural passes in parallel which are arranged in the direction intersecting the axial direction of the fan (including the direction intersecting at a right angle).

The fins may be in the form of a panel capable of passing air through, such as metal mesh, expanded metal, a punched plate or foam metal. Examples of the fin construction are shown in FIGS. 16–19.

In the above case, the heat exchanger is arranged in a descending position extending towards the front in relation to the casing and the intermediate part of the heat transfer tube in lengthwise direction bends at an acute angle so that it projects upwardly with respect to the fan. A drain receiving means, such as a drain pan, for receiving condensation from the heat exchanger may be provided below a front end portion and below a rear end portion of the heat exchanger.

Alternatively, the heat exchanger is arranged in a descending position extending towards the front in relation to the casing and the intermediate part of the heat transfer tube in lengthwise direction bends at an obtuse angle so that it projects upwardly and frontwardly with respect to the fan.

Also, the heat exchanger may be arranged in such a fashion that it slants downwardly towards the front of the casing, with no bending at the intermediate part.

Each pass of the heat transfer tube extends from one end of the heat exchanger to the other end, without being subjected to a bending process in the surface including fins. Alternatively, each pass of the heat transfer tube is subjected to a bending process in the same surface so that it has at least one reciprocating route extending from one end of the heat exchanger to the other end, where it bends toward the one end. In this case, the same surface including fins bends at the intermediate part of the heat transfer tube in lengthwise direction. Furthermore, the heat exchanger may comprise plural modules connected together which are folded at the boundary between modules in layers in vertical direction and each pass of the heat transfer tube in each module may be subjected to a bending process in the same surface so that it goes through a reciprocating route from one end of the module and then bends again at the one end to the other end side and extends toward the other end. This composition will facilitate manufacturing of the heat exchanger. Also, if each pass of the heat transfer tube at the boundary of the above module is slanted with respect to the lengthwise direction of the heat transfer tube, a bending radius of the pass at the boundary part becomes large and breakage of the tube can be prevented.

Alternatively, the heat exchanger may be composed in such a fashion that a plurality of modules are arranged in layers in a vertical direction and each module is composed by connecting a plurality of fins in layers to each pass of the heat transfer tube.

The air inlet is opened at the upper surface and/or at the front surface of the casing. The heat exchanger to be arranged in the air flow passage in the casing may be arranged on the downward slant to the front in relation to the casing and the intermediate part of the heat transfer tube in lengthwise direction may be bent at an acute angle so that it projects upwardly.

BRIEF DESCRIPTION OF THE DRAWINGS

The nature and advantages of the present invention will be understood more clearly from the following description made with reference to the accompanying drawings, in which.

DESCRIPTION OF PREFERRED EMBODIMENT

Figure 1:
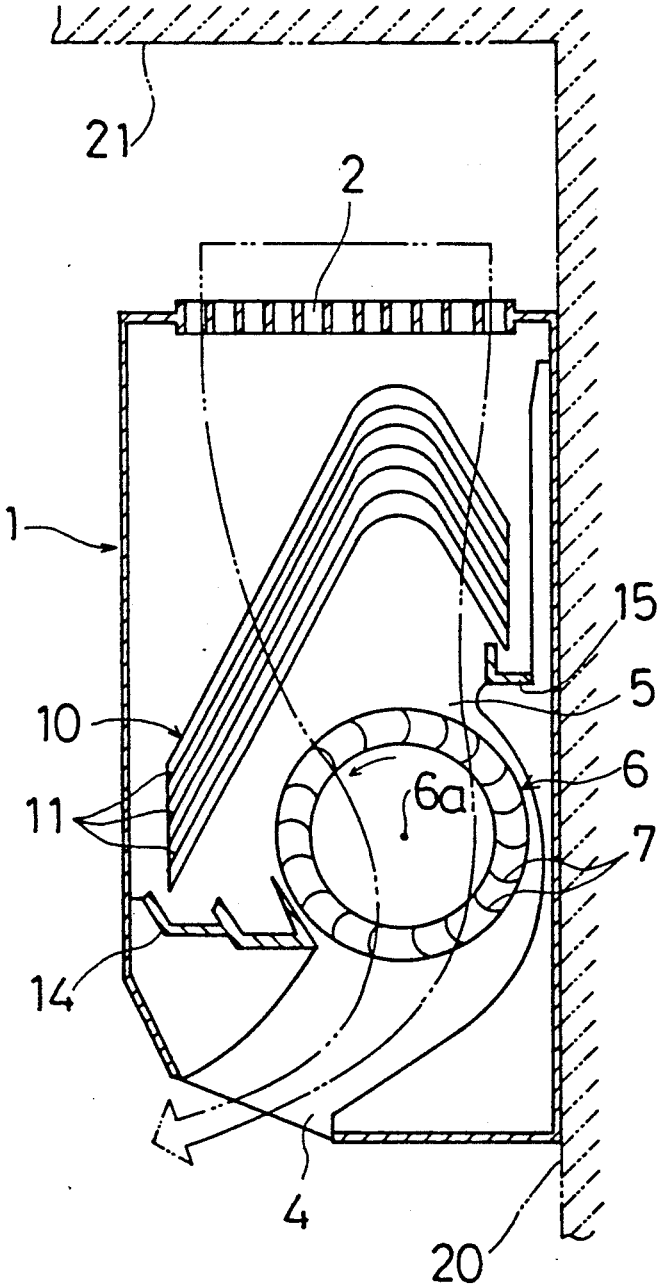
FIG. 1 is a cross section, along the vertical direction, of the air conditioner in Embodiment 1.
Figure 2:
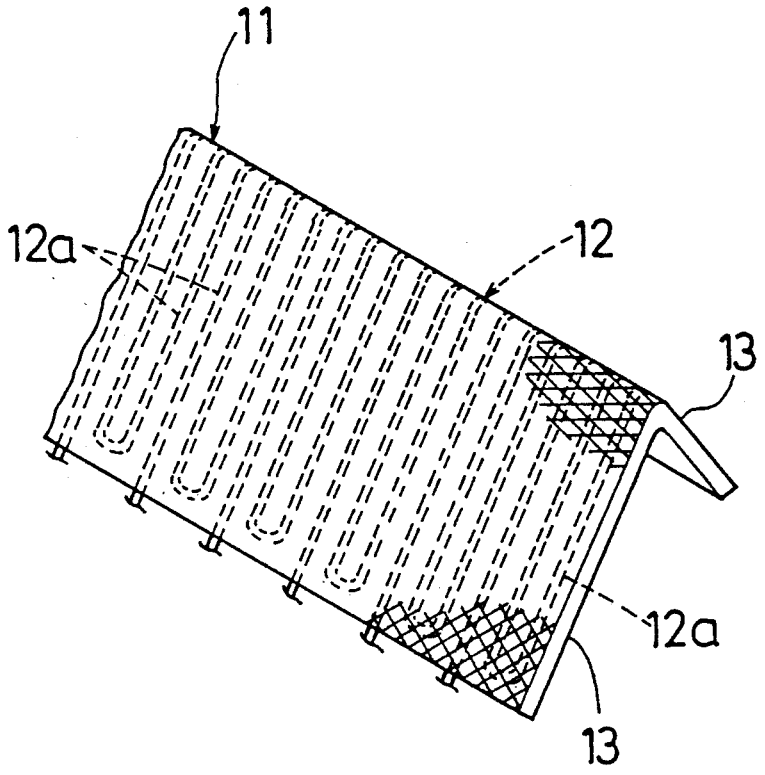
FIG. 2 is a perspective view of the heat exchanger module in Embodiment 1.
Figure 3:
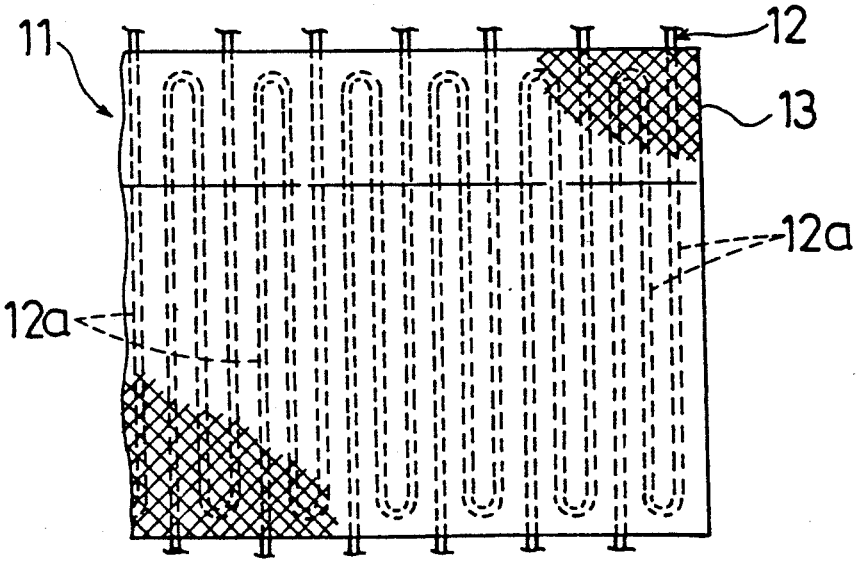
FIG. 3 is a plan view of the heat exchanger module in Embodiment 1.

FIG. 1 through FIG. 3 show Embodiment 1 of the present invention. In FIG. 1, reference numeral 1 designates a casing of a wall type air conditioner to be fixed to a wall 20 close to a ceiling 21 in the room. This casing 1 is of a rectangular box-shape and has an air inlet 2 opened at its upper surface and an air outlet 4 at a corner part of its front lower part. An air flow passage 5 is formed in the casing 1, extending from the air inlet 2 to the air outlet 4. A heat exchanger 10 and a cross flow fan 6 are arranged in series, from the air inlet 2 toward the air outlet 4, in the air flow passage 5.

As shown by a broken line in FIG. 1, the air in the room is taken in the casing 1 from the air inlet 2 by the cross flow fan 6 and the air taken in is heated or cooled by the heat exchanger 10 and is blown off through the air outlet 4.

The above cross flow fan 6 has an axial center 6*a* arranged in such a fashion that it crosses the air flow passage 5 in a right to left direction (in FIG. 1, the direction crossing at a right angle to the drawing paper). By rotating an impeller 7 around the axial center 6*a*, the air is passed through the fan in a direction crossing at a right angle with respect to the axial center 6*a*.

The heat exchanger 10 is connected between a distributer and a header. (not shown in the drawings). The heat exchanger comprises a plurality (seven in FIG. 1) of modules 11 arranged in layers in a vertical direction. As illustrated in FIG. 2 and FIG. 3 on an enlarged scale, each module 11 comprises the heat transfer tube 12 which connects a distributer and the header and fins 13 which are connected to the outer surface of the heat transfer tube 12 along the lengthwise direction of it and through which the air is allowed to flow. Examples of such fins being illustrated in FIGS. 16–19. The heat transfer tube 12 is branched into plural parallel passes 12*a* in the heat exchanger 10. As a feature of the present invention, each pass 12*a* of the heat transfer tube 12 is arranged in parallel along the plane (In FIG. 1, the direction in parallel with the drawing paper) crossing at a right angle to the axial direction of the cross flow fan 6. The heat exchanger 10 is generally arranged on the downward slant to the front in relation to the casing 1 and bends at an acute angle so that the rear part (from the center) of the lengthwise direction of the heat transfer tube 12 initially projects upwardly from the rear wall of the casing as shown in FIG. 1.

As shown in FIG. 3, in each module 11 each pass 12*a* of the heat transfer tube 12 is subjected to a bending process in the same surface including fins 13 so that it extends from one end (for example, a forward end) of the heat exchanger 10 to the other end (a rear end), where it bends toward one end side and bends again at the one end to the other end side and extends out the other end side. The same surface including fins 13 mentioned above is the surface along the heat exchanger 10, which bends at an acute angle so that the rear part (from the center) of the heat transfer tube 12 may project upwardly.

Drain pans 14, 15 for receiving condensation from the heat exchanger 10 are provided below the front end part and below the rear end part of the heat exchanger 10 in the casing 1.

In this embodiment, by rotation of the cross flow fan 6 (in a counter-clockwise direction in FIG. 1) the air in the room is taken into the casing 1 from the air inlet 2, the air taken in is heat exchanged by the heat exchanger 10 and is cooled or heated to the specified temperature and then is blown off from the air outlet 4.

Since each pass 12*a* of the heat transfer tube 12 in the heat exchanger 10 is arranged along the plane crossing at a right angle to the axial direction of the cross flow fan 6, even if variations in the air flow occur in the air flow passage 5 by the cross flow fan 6, the heat transfer tube 12 is arranged so that air flows substantially equally across the heat exchanger flow air flow. More particularly, even if the heat transfer tube 12 assumes the form of independence of passes 12*a* , the heat transfer tube 12 is barely influenced by the distribution of air flow speed passing through the heat exchanger 10 and accordingly it is possible to make the distribution of air flow speed and distribution of heat load in the air flow direction at each pass 12*a* almost equal. Therefore, if the distribution of refrigerant to passes 12*a* is set equally by a distributor, variation in refrigerant due to change of heat load caused by drift of the air can be prevented and a heat exchanging capacity of a high level can be ensured.

Since the heat exchanger 10 is arranged on the downward slant to the front in relation to the casing 1 and the intermediate part of the heat transfer tube 12 in lengthwise direction bends at an acute angle so that it projects upwardly, in comparison with the case of a plane-shaped heat exchanger (with no bending) the heat transferring area of the heat exchanger 10 per unit cross sectional area of the air flow passage 5 is large and heat exchanging capacity is improved to a large extent.

Moreover, since the heat exchanger 10 comprises modules 11 with fins 13 connected to the outer surface of the heat transfer tube 12, even if condensed water is generated at the heat exchanger 10, the condensed water flows down along the heat transfer tube 12 and fins 13. At the front side from the upper end bent part of the heat exchanger 10 condensed water flows into the drain pan 14 disposed below the front end portion of the heat exchanger 10 and at the rear side condensed water flows into the drain pan 15 disposed below the rear end portion of the heat exchanger 10 and finally condensed water is discharged from the casing 1. Therefore, notwithstanding that the intermediate part of the heat transfer tube 12 in lengthwise direction bends at an acute angle and projects upwardly, condensed water can be discharged effectively. This ensures improvement of heat exchanging capacity due to the increase in heat transferring area of the heat exchanger 10 and smooth discharging of condensed water.

Figure 4:
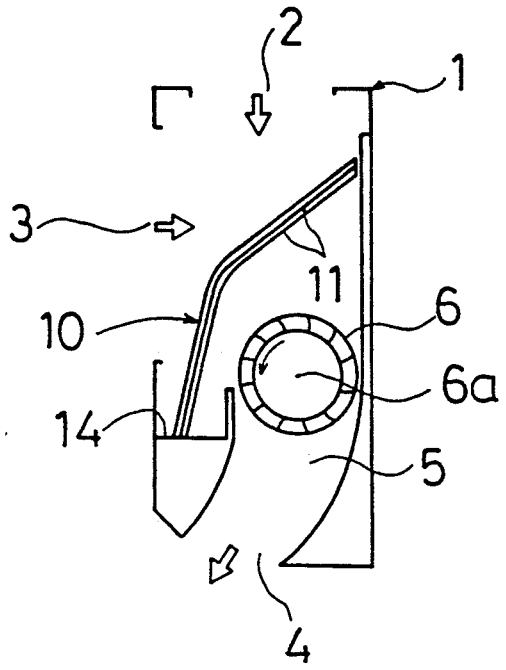
FIG. 4 is a cross section, showing typically the air conditioner in Embodiment 2.

FIG. 4 shows an air conditioner in accordance with Embodiment 2 of the present invention. In this and following embodiments, those parts which are the same as those in Embodiment 1 are given the same reference numerals and description of them is omitted.

Figure 5:
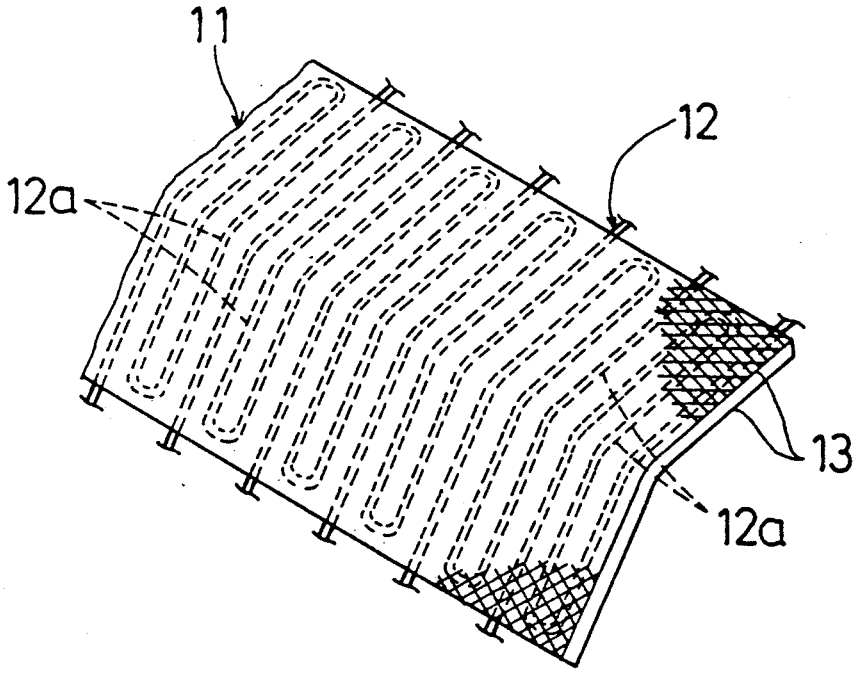
FIG. 5 is a perspective view of the heat exchanger module in Embodiment 2.

In this embodiment, an air inlet 3 is opened at the front upper part of the casing 1, in addition to the air inlet 2 at the upper part. Similar to Embodiment 1, the heat exchanger 10 has a plurality of modules 11 disposed in layers in vertical direction. As shown in FIG. 5, each module 11 of heat exchanger 10 is basically arranged on the downward slant to the front in relation to the casing 1 and the intermediate part of its heat transfer tube 12 in lengthwise direction bends at an acute angle so that it projects upwardly to the front.

Figure 6:
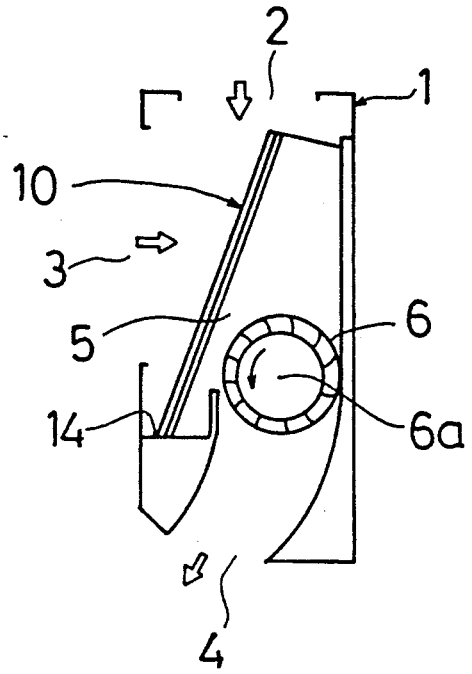
FIG. 6 is a cross section, showing typically the air conditioner in Embodiment 3.
Figure 7:
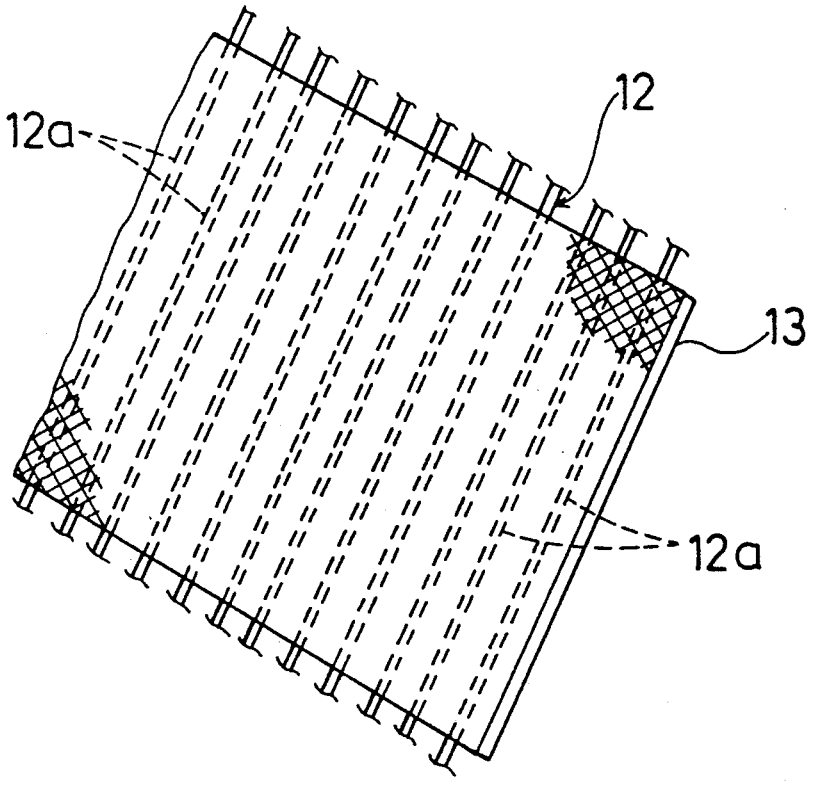
FIG. 7 is a perspective view of the heat exchanger module in Embodiment 3.

FIG. 6 shows the air conditioner in accordance with Embodiment 3 of the present invention. In this embodiment, as shown in FIG. 7 each module 11 in the heat exchanger 10 is arranged on the downward slant to the front in relation to the casing 1 and is plane-shaped. Each pass 12*a* of the heat transfer tube 12 extends rectinearly from a front end to a rear end of the heat exchanger 10, without being subjected to a bending process in the plane including fins 13 as in the case of Embodiment 1.

Figure 8:
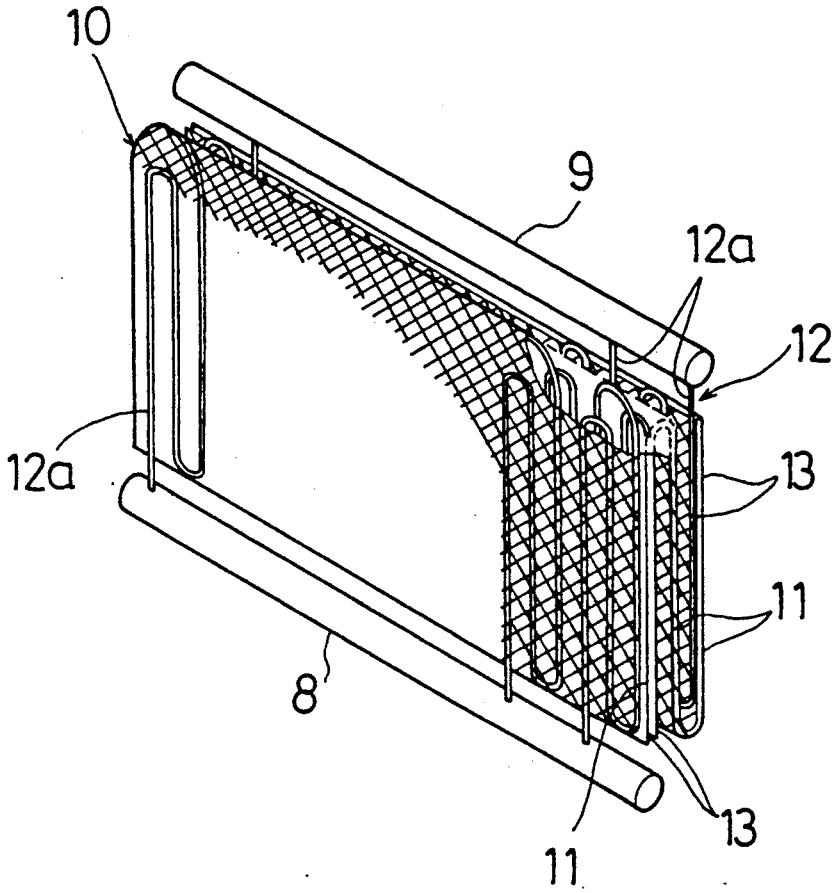
FIG. 8 is a perspective view of the heat exchanger in Embodiment 4.
Figure 9:
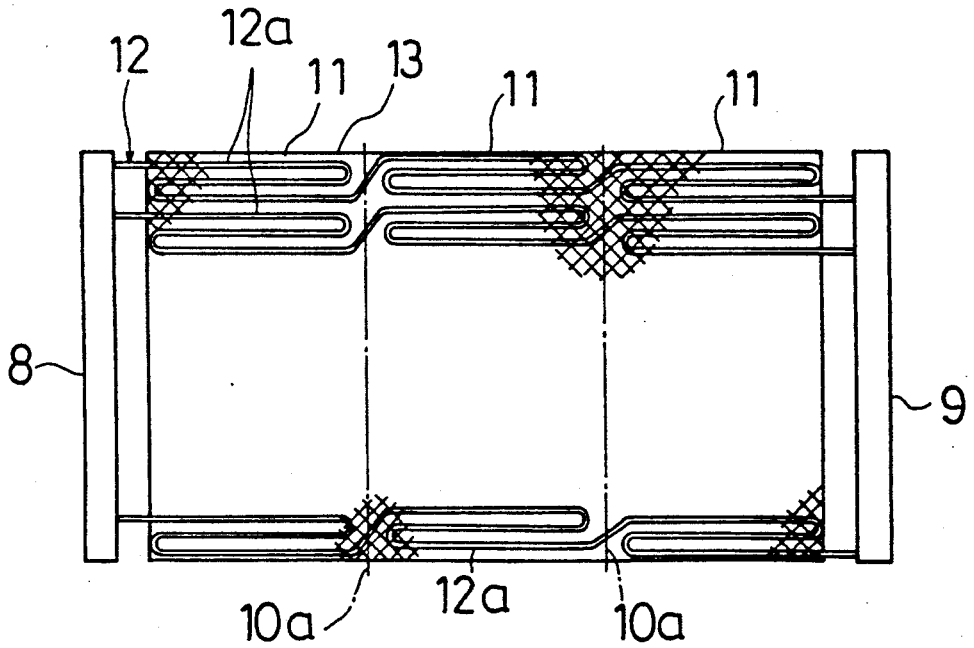
FIG. 9 is a plan view, showing the state of the heat exchanger before processing.

FIG. 8 shows a heat exchanger 10 in accordance with Embodiment 4 of the present invention. In this embodiment, manufacturing of the heat exchanger 10 composed by a plurality of modules arranged in the layers in vertical direction is facilitated. As shown in FIG. 9, in this embodiment plural modules 11 are made into one large panel-shaped module by putting plural passes 12*a* of the heat transfer tube 12 between plural fins 13, corresponding to several times (thrice in FIG. 9) the size of each module 11, in the heat exchanger 10. In each module 11, each pass 12*a* of the heat transfer tube 12 is subjected to a bending process in the same plane so that it extends from one end of the module 11 to the other end, where it bends toward the one end side and bends again at the one end to the other end side and then extends out to the other end side. Passes 12*a* of the heat transfer tube 12 in the intermediate module 11 are connected to passes 12*a* of the adjoining modules 11 at the boundary 10*a* and at this boundary 10*a*, each pass 12*a* is slanted in relation to the lengthwise direction of the heat transfer tube 12 (right and left direction in FIG. 9).

By folding the panel-shaped module 11 at the boundary 10*a*, plural modules 11 are laid in layers. These modules in layers are used as a heat exchanger 10. At this time, each pass 12*a* of the heat transfer tube 12 is folded at the boundary 10*a* between modules 11 but since each pass 12*a* is slanted at the boundary 10*a* in relation to the lengthwise direction of the heat transfer tube 12, its bending radius becomes large and breakage of each pass 12*a* can be prevented. Where necessary, this heat exchanger 10 may be folded as in the case of Embodiments 1 and 2. Reference numeral 8 designates a distributor and reference numeral 9 designates a header.

In this embodiment, manufacturing of the heat exchanger 10 is easy and a continuous manufacturing operation is possible. Accordingly, productivity is improved. Also, U-shaped tubes for bent parts in the pass 12*a* of the heat transfer tube 12 are unnecessary. Furthermore, by changing the bending position (position of the boundary part 10*a*) between modules 11, face area of the heat exchanger 10 can be easily changed.

Figure 10:
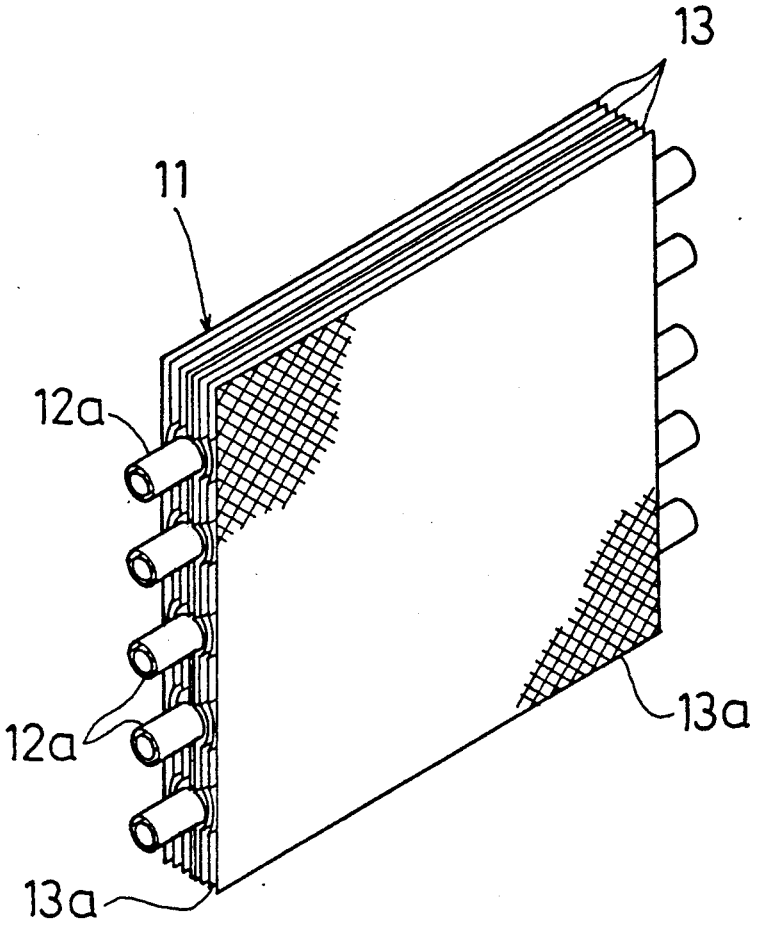
FIG. 10 is a perspective view of the heat exchanger in Embodiment 5.
Figure 11:
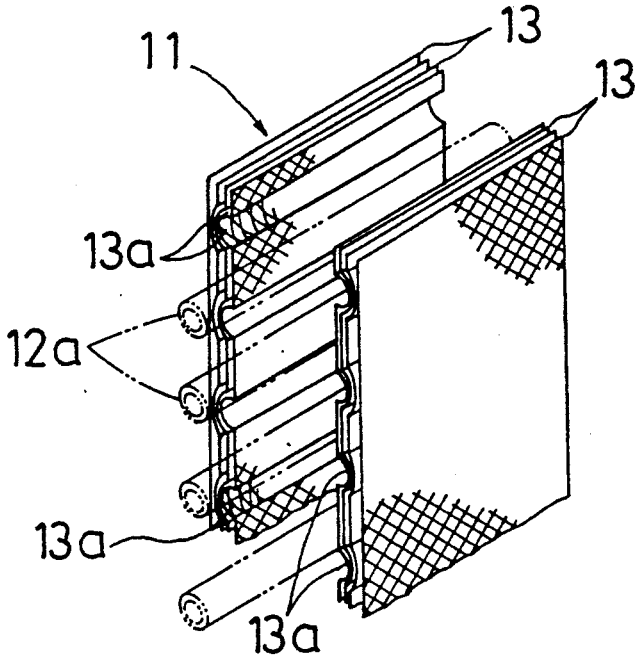
FIG. 11 is a perspective view of the heat exchanger in Embodiment 5 as it is disassembled.

FIG. 10 and FIG. 11 show Embodiment 5 of the heat exchanger in accordance with the present invention. Similar to Embodiment 1, in this embodiment the heat exchanger 10 is composed by laying plural modules in layers which are arranged in the vertical direction. Each module 11 is composed by connecting plural fins in layers to each pass 12*a* of heat transfer tube 12. Fins 13 vary in kind from the inside (on the heat transfer tube 12 side) toward the outside. Fins 13 at the inside have grooves 13*a* in which the heat transfer tube 12 is set. As to the depth of the groove 13*a* of the intermediate fins 13, the further the fin 13 is from the heat transfer tube 12, the smaller the depth of its groove. The fin 13 at the outermost part has no groove 13*a*. As shown in FIG. 10, the heat exchanger 10 is manufactured by laying fins 13 in layers one after another and connecting them to the heat transfer tube 12.

Figure 12:
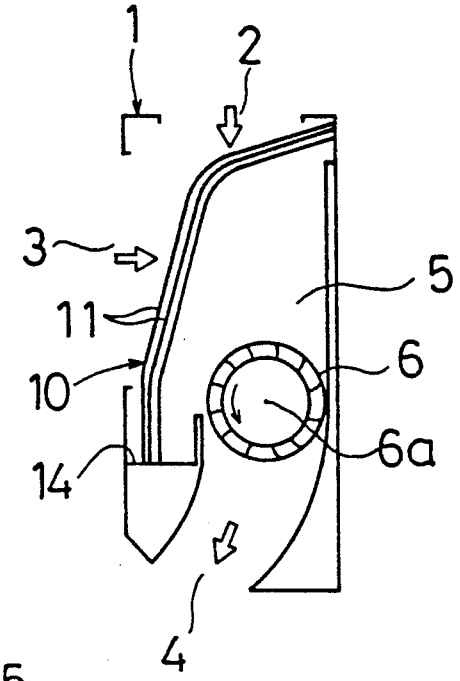
FIG. 12 is a cross section, showing typically the air conditioner in Embodiment 6.

FIG. 12 shows an air conditioner in accordance with Embodiment 6 of the present invention. In this embodiment, the heat exchanger 10 is arranged on the downward slant to the front in relation to the casing 1 and a rear end thereof is at the highest position. The heat exchanger 10 is bent frontwardly and slanted at two places at an obtuse angle (front and rear sides from the center of the heat transfer tube 12 in lengthwise direction) and its front part extends essentially vertical.

Figure 13:
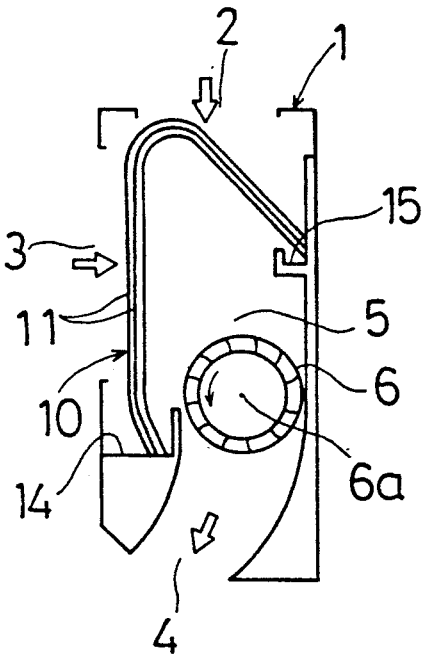
FIG. 13 is a cross section, showing typically the air condition in Embodiment 7.

FIG. 13 shows Embodiment 7 of the present invention. The heat exchanger 10 bends at an acute angle at the rear side part from the center of the heat transfer tuber 12 in lengthwise direction so that it projects upwardly. Front side of the bent part extends substantially vertical and the front end part slants downwardly to the rear.

Figure 14:
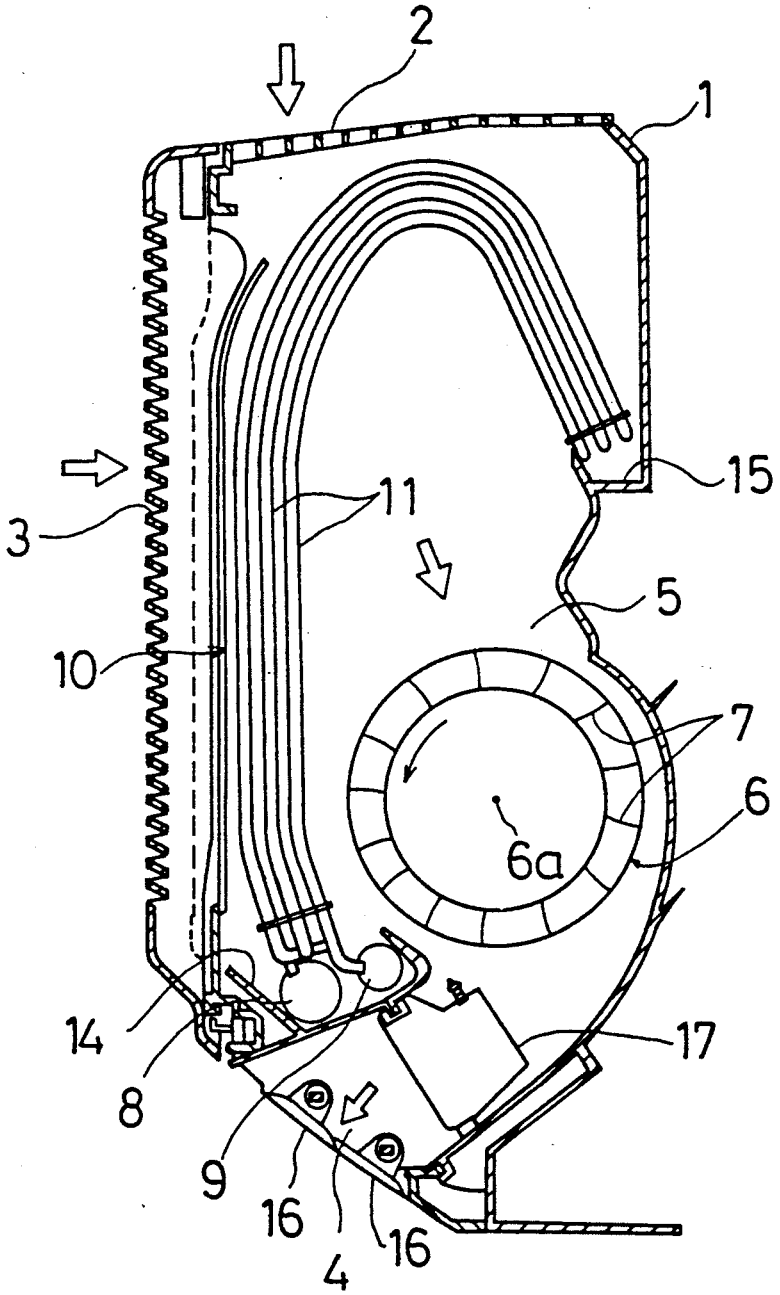
FIG. 14 is a cross section, along the vertical direction of the air conditioner in Embodiment 8.
Figure 16:
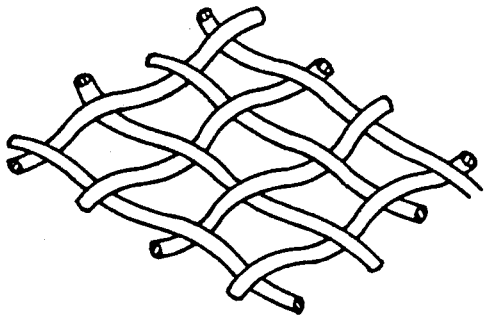
FIG.16 through FIG.19 are respectively perspective views illustrating alternative fin configuration.
Figure 17:
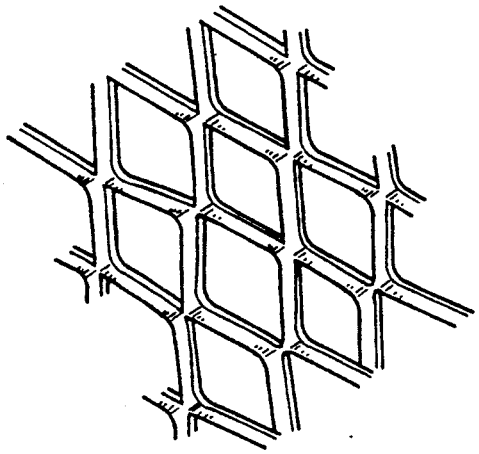
Figure 18:
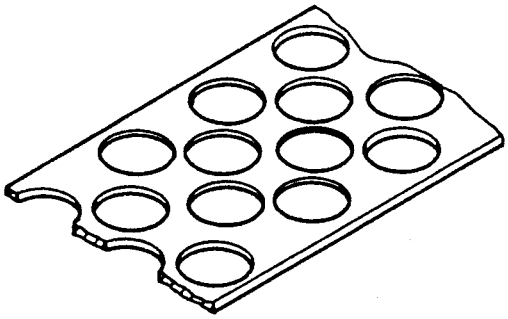
Figure 19:
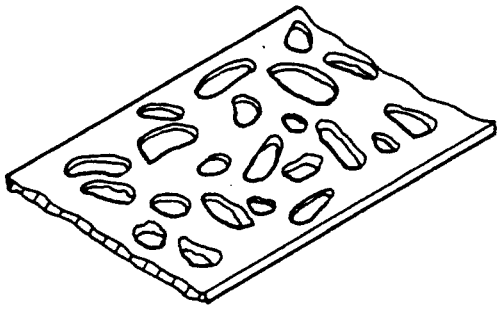

FIG. 14 shows an air conditioner in accordance with Embodiment 8 of the present invention. This embodiment is similar to Embodiment 7, except that a slant part which slants downward to the front is formed between an upper end bent part and a vertical part of the heat exchanger 10. Reference numeral 16 designates a louver arranged at the air outlet 4. This louver changes the air blowing direction up and down. Reference numeral 17 designates a louver arranged at the immediate upstream side of the louver 16. This louver 17 exchanges the air blowing direction right and left. In this embodiment, owing to the shape of the above-mentioned heat exchanger 10, it is possible to arrange each fin 13 in the direction crossing at a right angle to the flowing passage 5 from the air inlets 2, 3 and heat exchanging capacity of a high level can be obtained.

Figure 15:
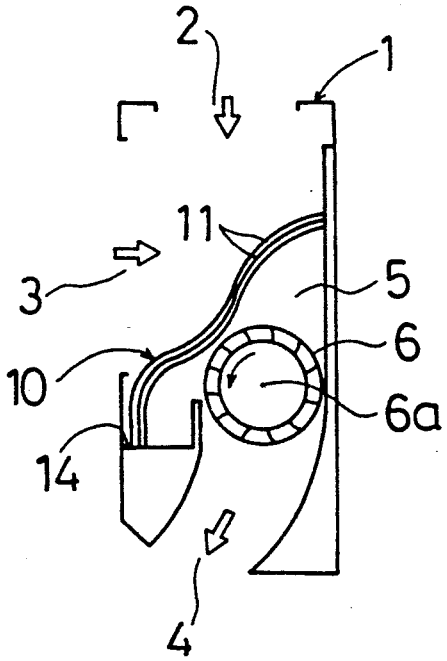
FIG. 15 is a cross section, showing typically the air conditioner in Embodiment 9.

FIG. 15 shows Embodiment 9 in accordance with the present invention. The heat exchange 10 is arranged on the downward slant to the front in relation to the casing 1 and its rear end is at the highest position. The heat exchanger 10 is bent frontwardly at an obtuse angle at two places (at the front and rear sides from the center of the heat transfer tube 12 in lengthwise direction). The part between the both bent parts is bent rearwardly representing nearly an M-shape as seen from the side.

The front lower part of the casing 1 may be angled, as illustrated in the several figures with the air out let 4 being provided therein.

What is claimed is:

1. An air conditioner comprising:

a casing having an air inlet opened at an upper side thereof, an air outlet opened at a lower side thereof and an air flow passage extending from said air inlet to said air outlet;

a cross flow fan disposed in said air flow passage within said casing, blades of which rotate around an axis extending substantially perpendicular to a direction of said air flow passage; and a heat exchanger having a heat transfer tube and perforated fins, disposed in series with said cross flow fan in said air flow passage within said casing, said heat transfer tube being branched into plural passes in parallel to one another in said heat exchanger and, said heat transfer tube passes and perforated fins being arranged in layers disposed in a direction intersecting the axial direction of said cross flow fan, said fins being connected to an outer surface of said heat transfer tube and extending at least in the direction of said heat transfer tube.

2. An air conditioner as defined in claim 1, wherein the heat exchanger is basically disposed on the downward slant to the front in relation to the casing and an intermediate part of the heat transfer tubes in lengthwise direction bends at an acute angle so that it projects upwardly.

3. An air conditioner as defined in claim 1, wherein the heat exchanger is basically disposed on the downward slant to the front in relation to the casing and an intermediate part of the heat transfer tubes in lengthwise direction bends at an obtuse angle so that it projects upwardly to the front.

4. An air conditioner as defined in claim 1, wherein the heat exchanger is disposed on the downward slant to the front in relation to the casing and is plane-shaped.

5. An air conditioner as defined in claim 2, wherein a drain receiving means for receiving drain from the heat exchanger is provided below the front end portion and below the rear end portion of the heat exchanger.

6. An air conditioner as defined in claim 1, wherein each pass of the heat transfer tube extends from one end of the heat exchanger to the other end thereof, without being subjected to a bending process in the surface including the fins.

7. An air conditioner as defined in claim 1, wherein each pass of the heat transfer tube is bent so that it has at least one reciprocating route extending from one end of the heat exchanger to the other end thereof, where it bends toward the one end.

8. An air conditioner as defined in claim 7, wherein the same surface including fins bends at an intermediate part of the heat transfer tube in lengthwise direction.

9. An air conditioner as defined in claim 7, wherein the heat exchanger is composed of a plurality of modules connected together which are folded at a boundary parrallel between modules in layers in vertical direction and each pass of the heat transfer tube in each module is subjected to a bent so that the tube goes through a reciprocating route from one end of the module and then bends again at the one end to the other end side and extends toward the other end.

10. An air conditioner as defined in claim 9, wherein each pass of the heat transfer tube at the boundary between modules is slanted in relation to the lengthwise direction of the heat transfer tube.

11. An air conditioner as defined in claim 1, wherein the heat exchanger is composed of a plurality of fins positioned in layers about each pass of the heat transfer tube.

12. An air conditioner as defined in claim 1, wherein the heat exchanger is basically disposed on the downward slant to the front in relation to the casing and the heat transfer tube bends at an acute angle so that an intermediate part of the heat transfer tube in lengthwise direction projects upwardly.

* * * * *